US008573473B1

(12) United States Patent
Farentinos et al.

(10) Patent No.: US 8,573,473 B1
(45) Date of Patent: Nov. 5, 2013

(54) MAIL RECEPTACLE

(71) Applicant: Architectural Mailboxes, LLC, Redondo Beach, CA (US)

(72) Inventors: Christopher Andrews Farentinos, Redondo Beach, CA (US); Craig Ronald Steele, Hawthorne, CA (US)

(73) Assignee: Architectural Mailboxes, LLC, Redondo Beach, CA (US)

( * ) Notice: Subject to any disclaimer, the term of this patent is extended or adjusted under 35 U.S.C. 154(b) by 0 days.

(21) Appl. No.: 13/765,548

(22) Filed: Feb. 12, 2013

Related U.S. Application Data

(60) Provisional application No. 61/598,179, filed on Feb. 13, 2012.

(51) Int. Cl.
*B65G 11/04* (2006.01)

(52) U.S. Cl.
USPC ..... 232/51; 232/45; 232/47

(58) Field of Classification Search
USPC ..... 232/44, 47–52, 43.1, 43.2, 45; 109/19, 109/66–68; 49/68
See application file for complete search history.

(56) References Cited

U.S. PATENT DOCUMENTS

| | | | | |
|---|---|---|---|---|
| 450,379 | A * | 4/1891 | Sinclaire | 232/51 |
| 625,819 | A | 5/1899 | Warfield | |
| 890,766 | A | 6/1908 | Hann | |
| 1,111,031 | A | 9/1914 | Petri | |
| 1,150,039 | A | 8/1915 | Klingaman | |
| 5,207,377 | A | 5/1993 | Brecht | |
| 5,938,113 | A | 8/1999 | Kim | |
| 5,979,751 | A | 11/1999 | Maddox | |
| 6,347,737 | B1 | 2/2002 | Madruga | |
| 6,719,195 | B2 | 4/2004 | Farentinos | |
| 6,976,620 | B2 * | 12/2005 | Swider | 232/45 |
| 7,252,220 | B1 | 8/2007 | Shreve | |
| 7,320,427 | B2 | 1/2008 | Prestwich | |
| 7,428,980 | B2 | 9/2008 | Irwin et al. | |
| 7,913,898 | B2 | 3/2011 | Frankenberg et al. | |
| 7,946,472 | B2 | 5/2011 | Bolles | |
| 8,136,718 | B1 * | 3/2012 | Snyder et al. | 232/44 |
| 8,220,703 | B2 * | 7/2012 | Bolles | 232/45 |
| 8,459,539 | B2 * | 6/2013 | Bolles | 232/45 |
| 2011/0220708 | A1 | 9/2011 | Bolles | |

* cited by examiner

*Primary Examiner* — William Miller
(74) *Attorney, Agent, or Firm* — Vista IP Law Group LLP

(57) ABSTRACT

A receptacle for receiving objects, such as mail or parcels, has a main housing having an input opening through which objects may be placed into the receptacle, and a hopper style door rotatable coupled within the housing. The hopper has bottom for receiving an object and a hopper cover disposed under the bottom. The hopper is rotatable between an open position in which the bottom is accessible through the opening and a closed position in which the hopper cover blocks the input opening. A flap is coupled to the hopper and is rotatable between an up position when the hopper is in the open position in which the flap forms a back wall adjacent the rear edge of the bottom, and a down position when the hopper is in the fully closed position in which the flap allows an object to slide off the bottom and out of the hopper.

20 Claims, 16 Drawing Sheets

MAIL RECEPTACLE

CROSS-REFERENCE TO RELATED APPLICATIONS

This Application claims the benefit of U.S. provisional Application No. 61/598,179, filed on Feb. 13, 2012, in accordance with 35 U.S.C. Section 119(e), and any other applicable laws. The contents of the aforementioned application(s) are hereby incorporated herein by reference in their entirety as if set forth fully herein.

BACKGROUND

The field of the invention generally relates to receptacles for receiving objects while preventing unauthorized access to the received objects, and more specifically to mail receptacles for receiving parcels and packages such as from delivery services, such as the United States Postal Service (USPS), Federal Express, United Parcel Service (UPS), or other private carriers and delivery services, and the like.

A variety of parcel receptacles have been previously provided, including some having devices for restricting access to parcels deposited into the receptacle to prevent theft or vandalism. For example, U.S. Pat. No. 7,428,980, issued to Irwin et al., discloses a parcel collection device having a bin which rotates between an open position in which parcels may be deposited into the bin and a closed position in which the parcels drop into a storage area or other storage base. The bin includes a front wall and a bottom wall connected together in an L-shape. The bin also includes a rotating trap door that forms a top of the bin opposing the front wall and, in the open position of the bin, the trap door is in a closed position with a first edge of the trap door adjacent the bottom wall. Thus, when the bin is in the open position, the trap door blocks access into the storage area. When the bin is rotated to the closed position, the trap door rotates such that the first edge of the trap door moves away from the bottom wall creating an opening through which a parcel placed in the bin can drop into the storage area.

Several other representative examples of parcel receptacles with access restricting devices are shown in U.S. Pat. No. 625,819, to Warfield; U.S. Pat. No. 890,766 to Hann; and U.S. Pat. No. 1,111,031 to Petri, which provide further background for the present.

SUMMARY

The present invention is directed to an innovative receptacle for receiving objects deposited into the receptacle, while also restricting access to parcels after they are deposited into the receptacle and dropped into a drop area such as a storage compartment, storage cart, or other secure storage area. For example, the receptacle may be a stand-alone receptacle having a storage compartment or it may be a structure mounted unit (such as a wall or other supporting structure) to which the receptacle is mounted allowing objects to be placed into the receptacle on one side of the structure and then deposited into a drop area on the other side of the structure.

In one embodiment, the receptacle comprises a main housing, which can be wall-mounted, post-mounted, or floor-mounted (e.g. stand-alone). The main housing has a housing cover having an input opening for receiving an object being deposited into the receptacle. A hopper is rotatably coupled to the housing and is disposed within the housing cover. The hopper has a bottom and two side panels extending from either side of the bottom. The bottom has a front edge adjacent to the input opening of the housing and a rear edge distal to the front edge (i.e. further away from the input opening and within the housing). The hopper also has a hopper cover disposed under the bottom. The hopper is rotatable between a fully open position in which the bottom is accessible through the input opening in the housing and a fully closed position in which the input opening is at least substantially blocked by the hopper cover.

In order to help restrict access through the input opening and past the hopper where deposited parcels are dropped from the hopper and stored, a flap is rotatably coupled to the hopper and positioned adjacent the rear edge of the bottom of the hopper. When the hopper is in the fully open position, the flap is in an up position such that the flap forms a back wall adjacent the rear edge of the bottom and extending upward above the rear edge. As the hopper is rotated from the fully open position to the fully closed position, the flap gradually rotates relative to the hopper into a down position in which the flap allows an object placed on the bottom to slide off over the rear edge of the bottom and completely off the bottom. The object then falls into a drop area, such as a storage compartment.

In another aspect, the flap has a guide device that travels along a guide track to move the flap between the up position and the down position relative to the bottom of the hopper. The guide track may be specifically configured to control the speed and orientation of the flap to allow receipt of objects into the receptacle, while also restricting access to the drop area. For example, as the hopper is gradually opened from the fully closed position, the flap may move relatively quickly from the down position where it is lower relative to the bottom of the hopper to a position above the bottom of the hopper such that the flap blocks part of the pathway between the bottom and the drop area. As the hopper is further opened, the flap may move relatively more slowly into the up position where it is at its maximum height above the bottom and forms a wall at the rear edge of the bottom. In the up position, the flap may form a barrier against a back wall of the housing.

Other aspects and features of the receptacle may include additional components for restricting unwanted access into the receptacle, and diverting liquids such as a rain from the interior of the housing and the drop area. For example, a drainage system may include a gutter, deflector and/or a brush to prevent water from breaching the housing. Also, the hopper, mail redirector, and/or floor of the housing may be striated to minimize friction and facilitate movement of deposited objects, such as mail, as the objects drop from the hopper and into the drop area. The hopper cover may be curved to maintain a minimal gap between the edge of the input opening, making it difficult to reach in or see the contents of the receptacle.

A spring mechanism coupled between the hopper and the housing may be used to provide a force on the hopper, such as a force biasing the hopper towards closing or otherwise assisting in closing the hopper. A front lip on the top of the housing cover and a front lip on the hopper may cooperate to limit accessibility to the contents of the housing by controlling and reducing the angle of access through the input opening when the hopper is completely closed to slightly open and also when hopper is partially open with the flap partially rotated toward the up position to prevent access to the drop area. A weather-stripping such as foam, a brush, silicone, rubber, or the like, may be used to visually seal the small gap between the hopper cover and the housing and/or a gutter.

The front lip of the top of the housing cover, the front edge of the hopper, the hopper and flap limits of rotation, the hopper bottom design, the hopper center of rotation relative to the housing, the hopper center of rotation relative to the hopper, the flap shape and size, and the overall receptacle dimensions all work in concert to define the size and shape of items that can be delivered and the degree of theft-prevention. These features may be adjusted for different applications with different anti-theft and delivery requirements. Examples of different applications for the receptacle include mail receptacles, library drops, laundry drops, key drops, pharmaceutical drops, airport security drops, and receptacles for use indoors or outdoors where the overall security environment may be different.

In one embodiment, the receptacle is configured as a mail parcel receptacle and is specifically designed to receive a medium sized United States Postal Service flat rate box having the dimensions: length of 11.25 inches, width of 5.75 inches and height of 8.75 inches.

The operation and use of the mail receptacle is fairly straightforward. The receptacle starts with the hopper in the fully closed position, with the hopper cover blocking the input opening and the flap in the down position. In the fully closed position, the bottom is typically at a steep angle to horizontal so that an object on the bottom will slide off the bottom and into the drop area. To receive an object, the hopper is rotated toward the open position. As the hopper rotates toward the open position, the hopper cover begins to rotate below the input opening of the housing, and the flap rotates from the down position into a position where it starts to block part of the pathway between the bottom and the drop area. As the hopper is rotated to the fully open position, the cover moves away from the input opening so that it does not block the input opening, and allows access to the bottom through the input opening so that an object may be placed onto the bottom of the hopper. In the fully open position, the bottom of the hopper may be about horizontal (within 10° ("degrees") of horizontal), and the flap is in the up position forming a wall adjacent the back edge of the bottom. The object is then placed on the bottom of hopper.

The hopper is then rotated in the opposite direction from the fully open position toward the closed position. As the hopper is rotated toward the closed position, the hopper cover begins to block the input opening, the flap rotates from the up position toward the down position, and the object may slide along the bottom toward the flap. As the hopper continues to rotate to the fully closed position, the flap rotates to the down position, allowing the package to slide off the bottom through the pathway between the bottom and the flap, and drops into the drop area. At the same time, the hopper cover moves to completely block the input opening.

If the receptacle has a storage compartment, the object may be removed from the receptacle as follows. An access door of the storage compartment is opened. If so configured, the flap may be rotated out of the way of the door opening, and the object can be removed through the door opening.

DETAILED DESCRIPTION

Figure 1:
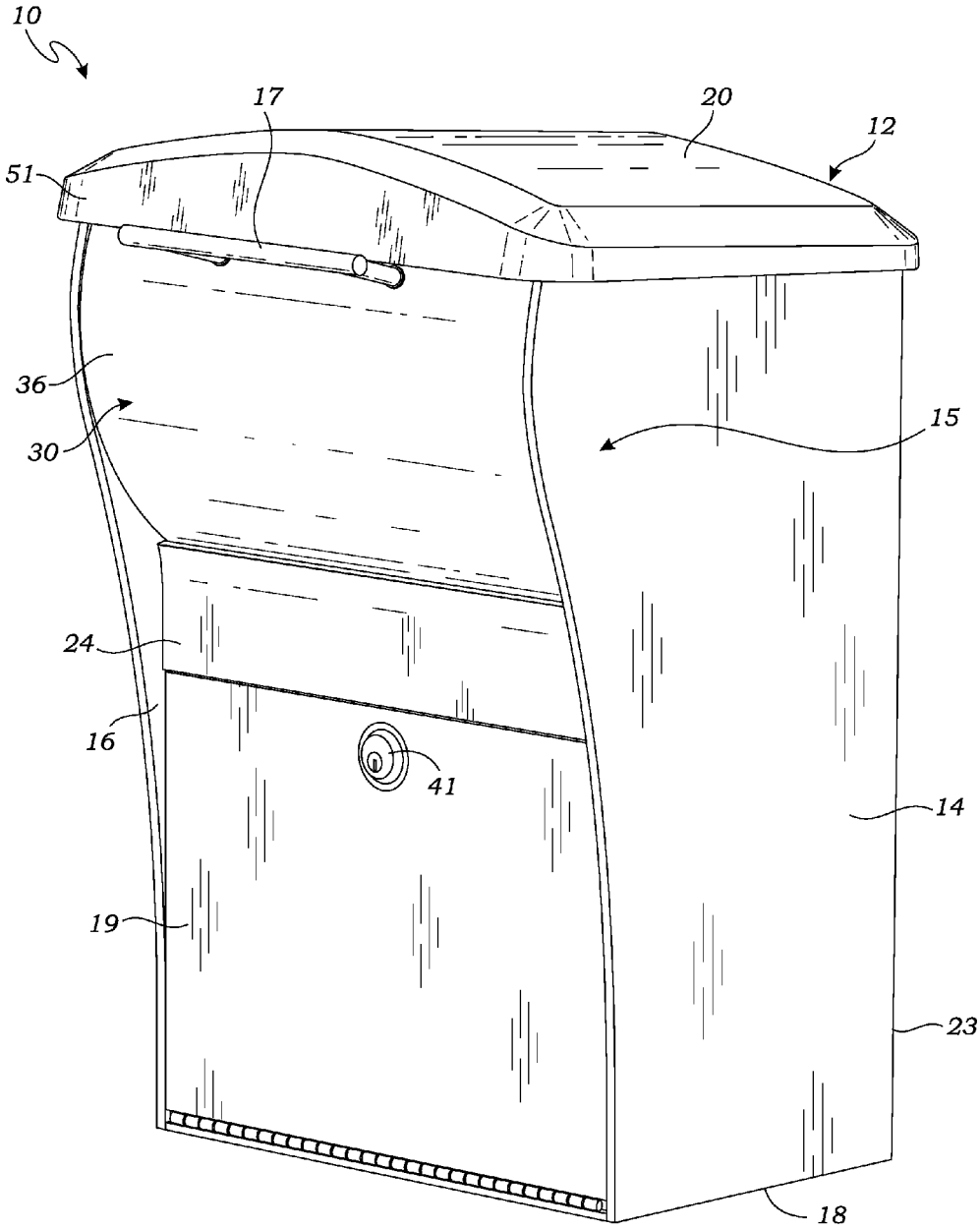
FIG. 1 is a side perspective, view of a receptacle with the hopper in the fully closed position, according to one embodiment of the present invention.

Turning first to FIGS. 1-8, one embodiment of a receptacle 10 according to the present invention is shown. The receptacle 10 comprises a housing 12 that generally forms the enclosure for the receptacle 10. The housing 12 may have a frame (not shown) and one or more walls that forming a housing cover 15. For example, the housing cover 15 of the receptacle 10 may include a first sidewall 14, a second sidewall 16, a back wall 23, a front wall 24, a bottom wall 18, and a top 20. The housing cover 15 has an input opening 22 in the front side of the receptacle 10.

The embodiment of the receptacle 10 in FIGS. 1-8 is a stand-alone model in which the housing 12 has a drop area 39 in the form of a storage compartment 39 below the hopper 30. As described below, objects deposited into the receptacle 10 drop from the hopper 30 into the drop area 39. An object redirector or ramp 72 may be disposed within the drop area, typically along the back wall 23. When an object being deposited into receptacle 10 falls into the drop area 39, it hits the redirector 72 and is pushed toward the front of the drop area 39 nearer the access opening 43.

The housing 12 has an access opening 43 (see FIG. 15) covered by an access door 19 which can be opened to provide access to the storage compartment 39 through the access opening 43 to remove an object from the storage compartment 39. The access door 19 is sized such that any object the receptacle 10 can receive can subsequently fit through the opened access door 19. The access door 39 may have a locking latch 41 which can be locked to secure the storage compartment 39 and unlocked to open the access door 39. The locking latch may be unlocked using a key, keycard, combination lock, fingerprint reader, or other security mechanism. The access door 39 may be sized such that any object the receptacle 10 can receive can subsequently fit through the opened access door 39.

A housing front lip 51 may be provided on the top 20 of the housing cover 15 just above the opening 22 to further limit accessibility through the opening 22 and past the hopper 30 into the drop area 39. The housing front lip 51 extends across the entire width of the top edge of the opening 22 and extends downward from the top 20.

Figure 15:
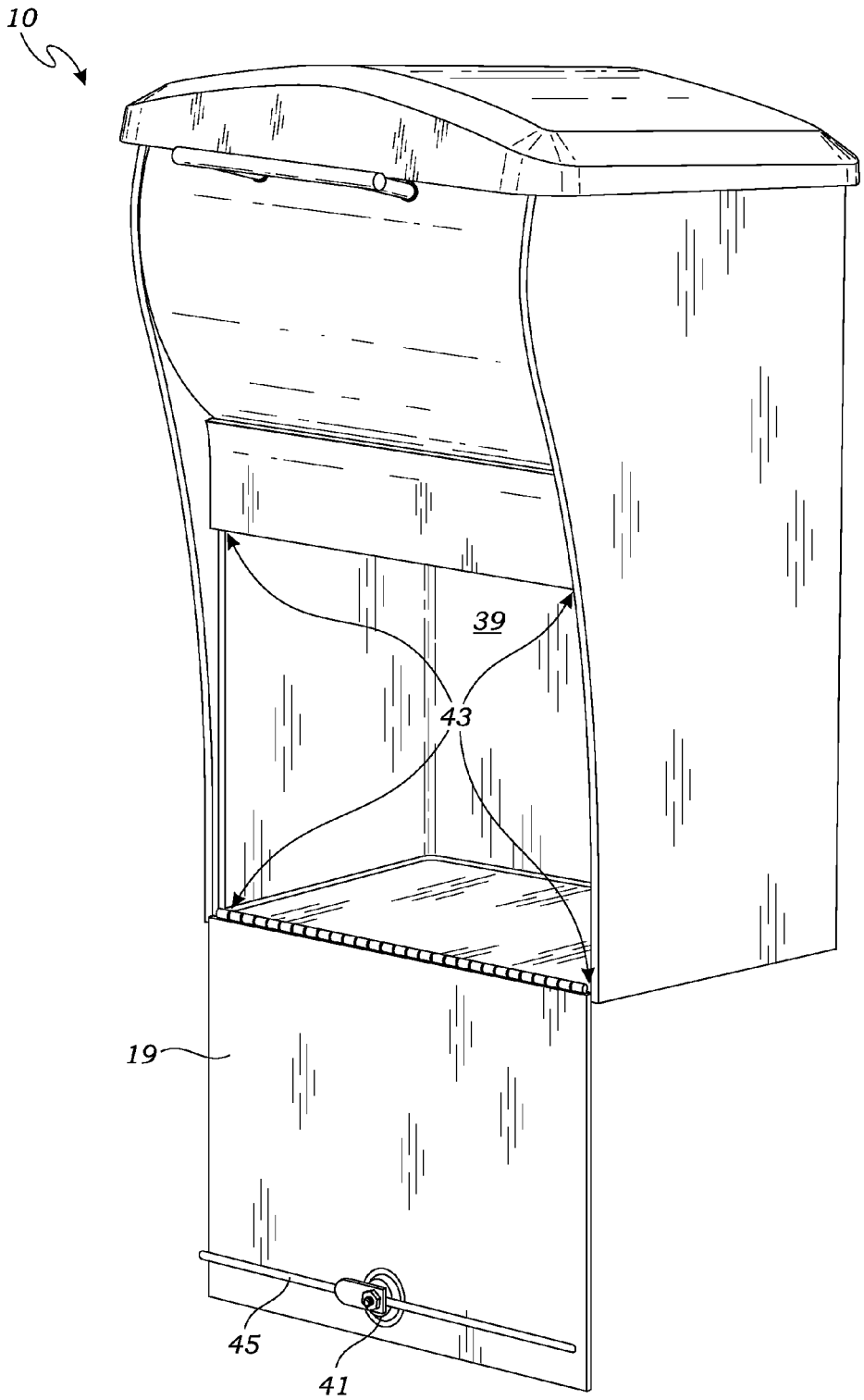
FIG. 15 is a side perspective view of the receptacle of FIG. 1 with the access door in open position.

As shown in FIG. 15, in this embodiment, the access door 39 latches at the top and is hinged at the bottom, such that the access door 39 opens downward so it is completely out of the way of retrieval and remains open unassisted. The locking latch 41 can be a simple latch having a single latch, or it can have a bar linkage 45 that engages the housing 12, such as a frame or other structure of the housing 12. For instance, a three-point or multi-point locking system strengthens theft prevention. The sidewalls 14 and 16 may extend proximal the front surface of the access door 39 to minimize the gap into which a screwdriver or other prying instrument can fit. In other embodiments, the access door 39 may be hinged at the top or either side, such that the access door opens upward or to the side.

A hopper 30 is rotatably coupled to the housing 12 and is disposed within the housing cover 15. The hopper 30 comprises a bottom 32 and two side panels 34, one on each side of the bottom 32 and extending upward from the bottom 32. The bottom 32 has a front edge 33 adjacent the opening 22 and a rear edge 35 distal to the front edge 33. The front edge 33 of the bottom 32 may have a front lip 37 which extends upward from the bottom 32 which helps indicate when an object is placed completely onto the bottom 32 and that it will fit into the receptacle (i.e. it is not too big for the receptacle), and also helps to prevent unwanted access to a drop area 39 below the hopper 30. The hopper 30 also has a hopper cover 36 disposed under the bottom 32 and connected to bottom 32. The hopper cover 36 has partial cylinder shaped outer surface. The outer surface of the hopper cover 36 is located close to the edges of the input opening 22 as the hopper cover 36 rotates with the rotation of the hopper 30. The hopper 30 is rotatably coupled to the housing 12 by a pair of rotating shaft and bushing assemblies 38 each attached to a respective side panel 34 and a respective side wall 14, 16 of the housing 12. A handle 17 is attached to the hopper cover 36 for manually rotating the hopper 30 between the open position and closed position.

Figure 2:
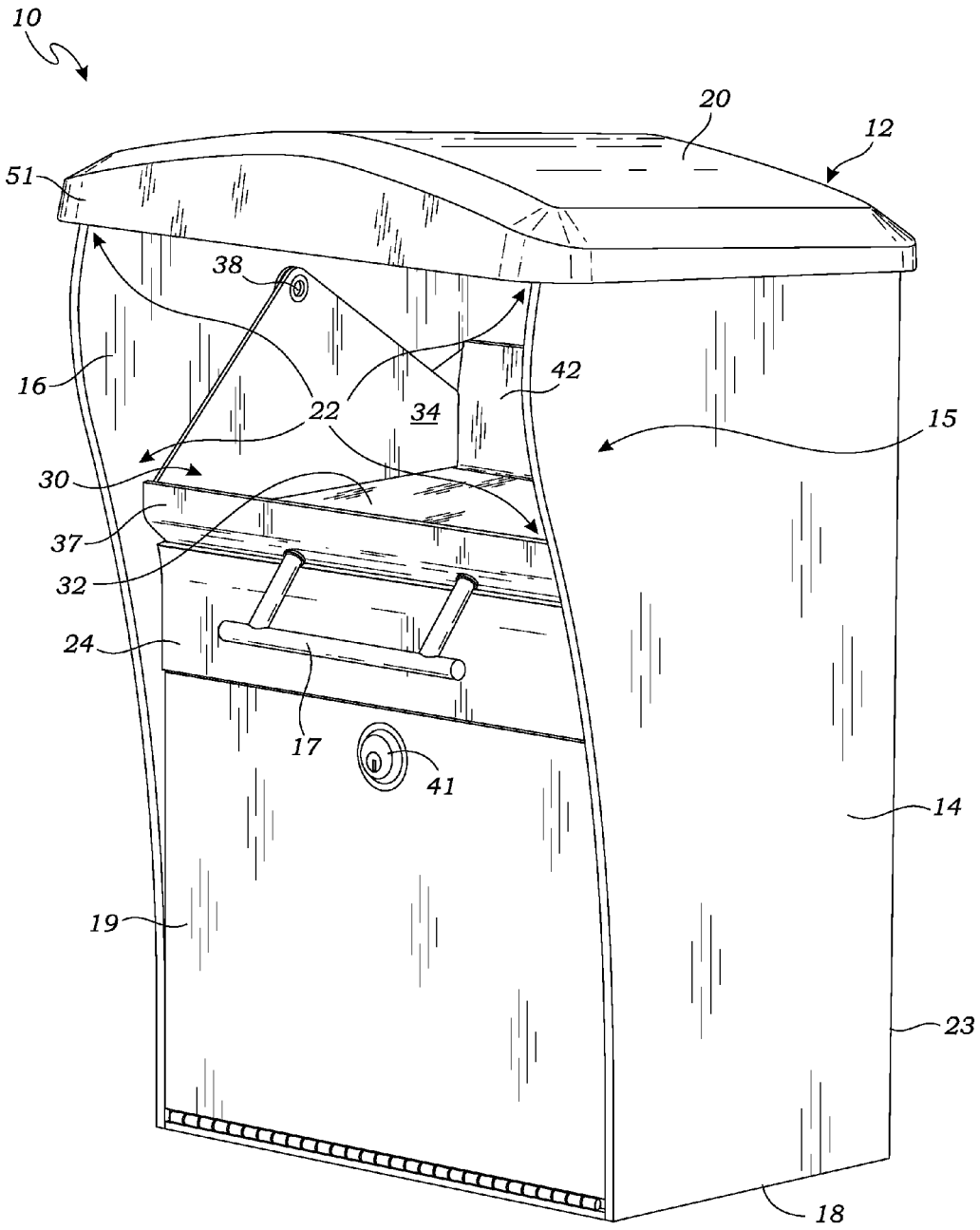
FIG. 2 is a side perspective, view of the receptacle of FIG. 1, with the hopper in the fully open position.
Figure 3:
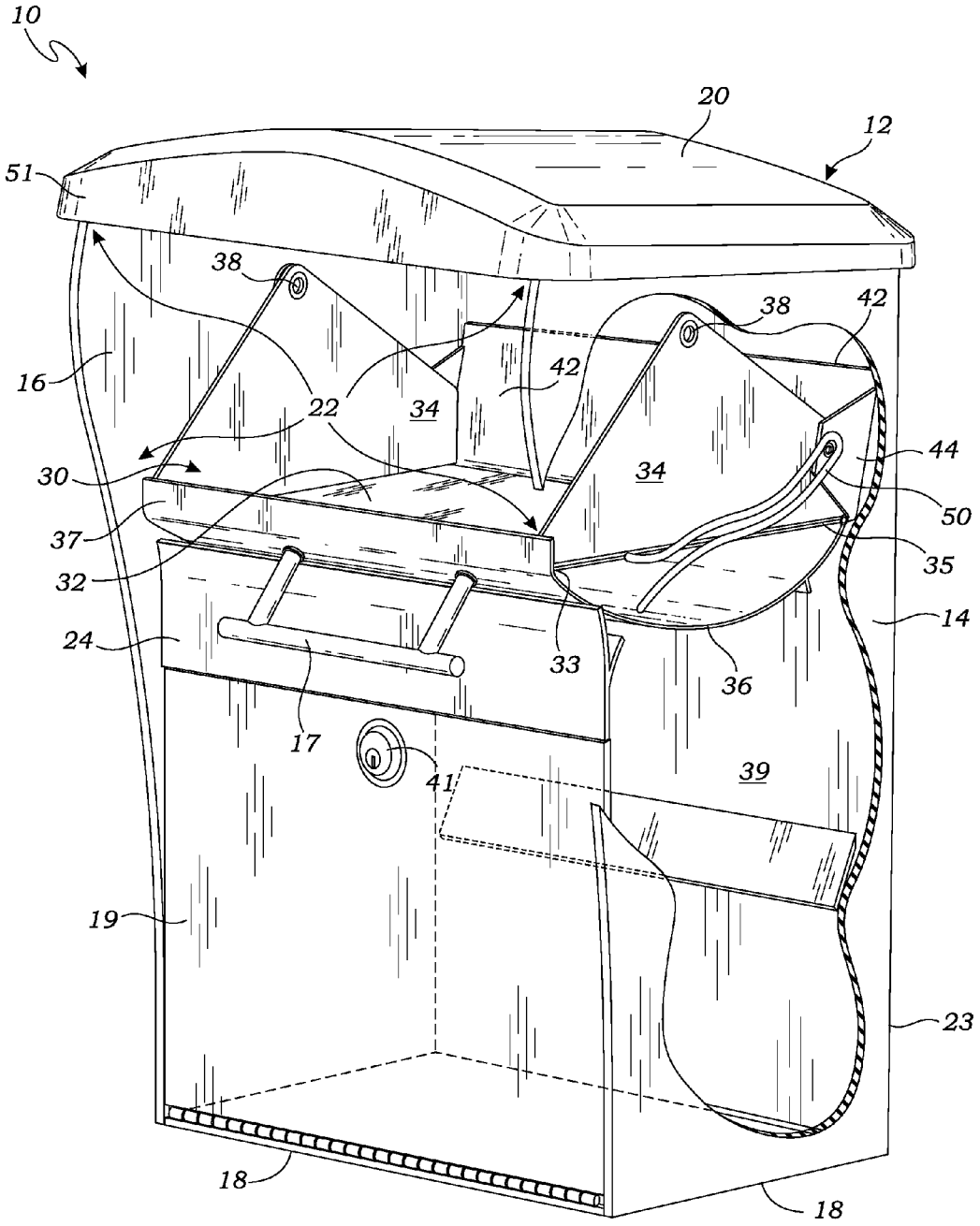
FIG. 3 is a side perspective, cutaway view of the receptacle of FIG. 1.
Figure 4:
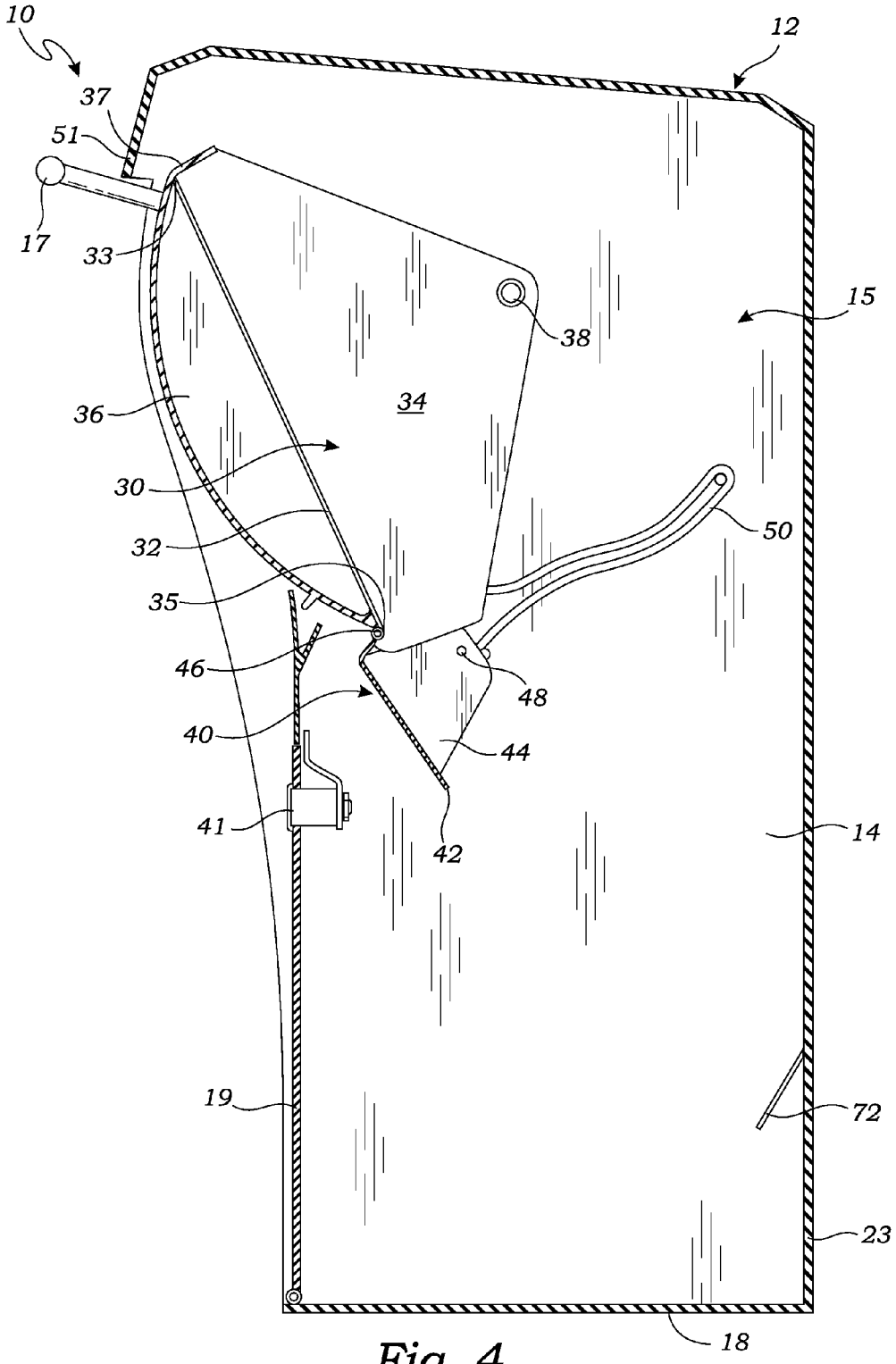
FIG. 4 is a side view of the receptacle of FIG. 1 with the hopper in the fully closed position according to one embodiment of the present invention.
Figure 6:
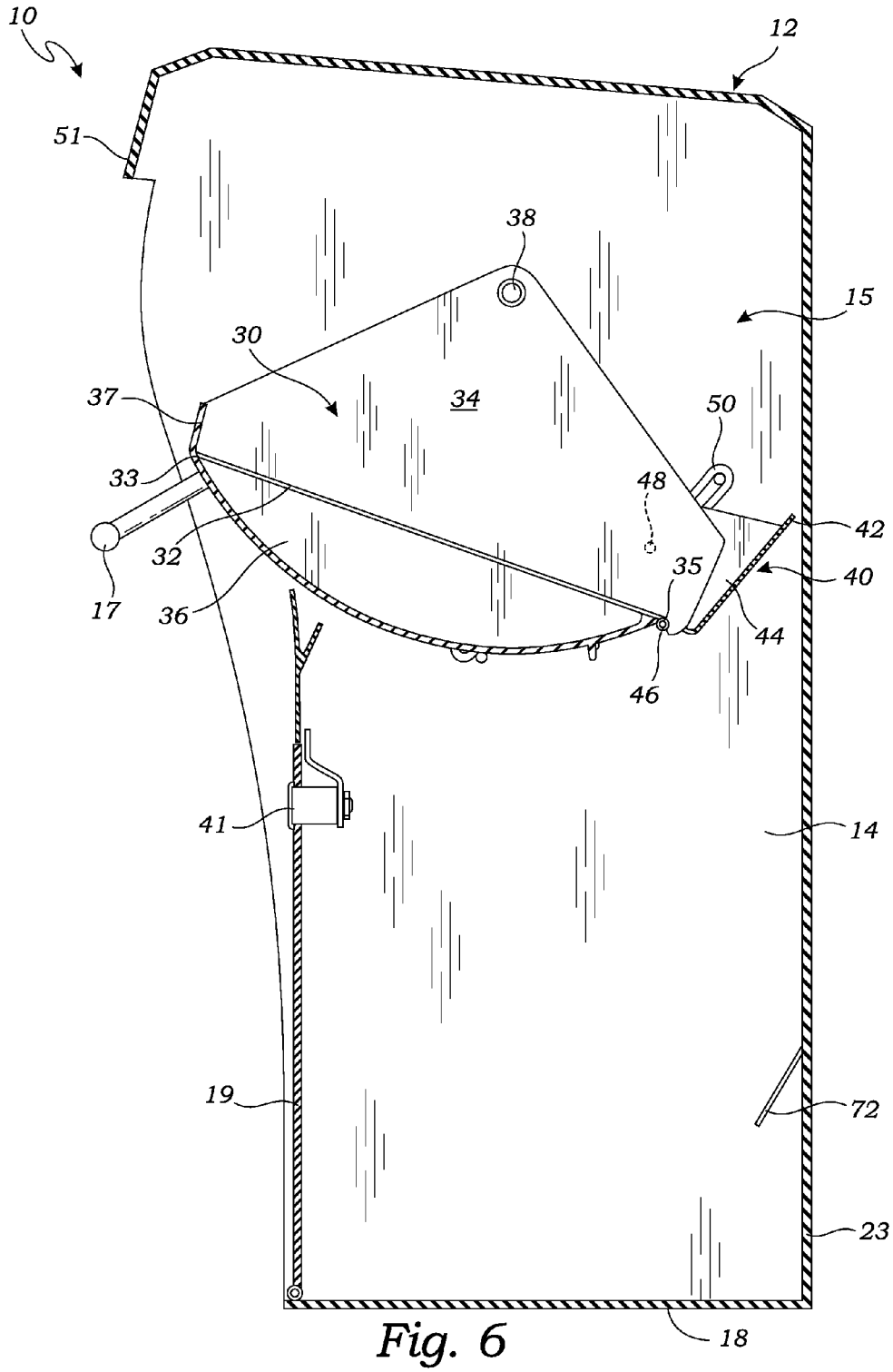
FIG. 6 is a side view of the receptacle of FIG. 1, with the hopper rotated even further toward the fully open position.
Figure 7:
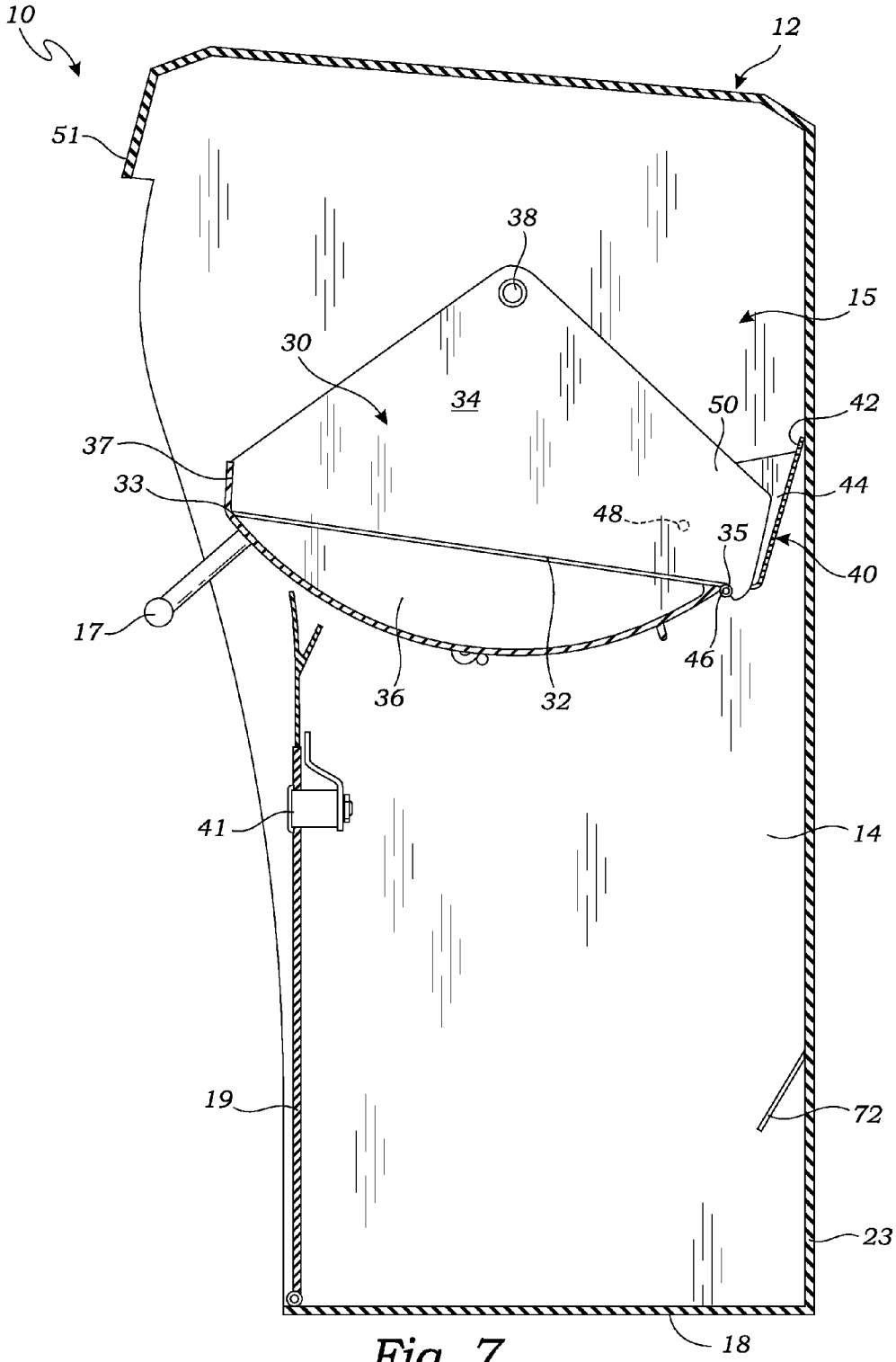
FIG. 7 is a side view of the receptacle of FIG. 1, with the hopper rotated almost to the fully open position.
Figure 8:
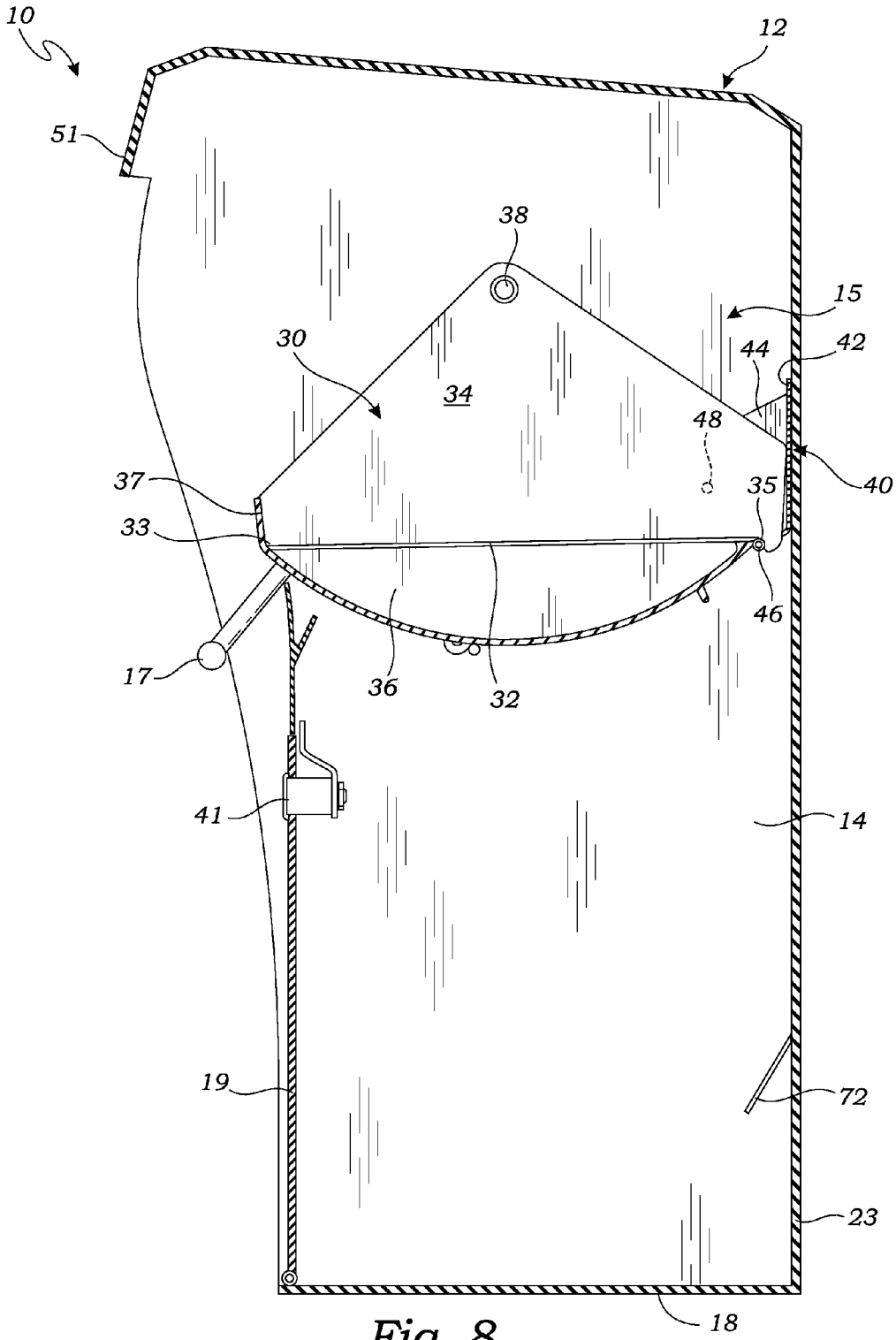
FIG. 8 is a side view of the receptacle of FIG. 1, with the hopper rotated to the fully open position.

The hopper 30 rotates about the shaft and bushing assemblies 38, which form a pivot point, from a fully closed position as shown in FIGS. 1 and 4, to a fully open position as shown in FIGS. 2 and 8. In the fully closed position, the front edge 33 of the bottom 32 is located at or near the top edge of the opening 22, and the cover 36 at least substantially blocks the opening 22. As the hopper 30 is rotated open (counterclockwise in the orientation shown in FIGS. 1-8), the cover 36 moves downward out of the way of the opening 22, as shown in FIGS. 4-7. At the fully open position, the front edge of the bottom 32 is located at or near the bottom edge of the opening 22, and the hopper-cover 36 is substantially out of the way of the opening 22, thereby providing access to the bottom 32 of the hopper 30, such that an object can be placed on the bottom 32 (i.e. the hopper receiving area formed between the bottom 32 and the two side panels 34).

As better shown in the cutaway and side views of FIGS. 3-8, a flap 40 is rotatably coupled, for example by a hinge along edge 35, to the back portion of the hopper 30 near or at the rear edge 35 of the bottom. The flap 40 moves along with rotation of the hopper 30, and also rotates relative to the hopper 30. The flap 40 comprises a main wall 42 and two flap sidewalls 44, one on each end of the main wall 42 extending from each side of the main wall 42. The flap 40 is rotatably coupled to the hopper 30 using rotatable couplings, such as a hinge 46 along edge 35. Alternatively, the may be rotatably coupled to the hopper 30 using When the hopper 30 is in the fully open position, the flap 40 is in an up position such that the flap 40 forms a back wall adjacent the rear edge 35 of the bottom 32 and extending upward above the rear edge 35. As the hopper 30 is rotated from the fully open position to the fully closed position, the flap 40 gradually rotates relative to the hopper 30 into a down position in which the flap 40 allows an object placed on the bottom 32 to slide off over the rear edge 35 of the bottom 32 and completely off the bottom 32 into the drop area 39.

The movement of the flap 40 may be controlled by cooperating guide devices 48 and guide tracks 50. The flap 40 has a pair of guide devices 48, one attached to and extending from each flap side wall 44. The guide devices 48 may be a pin, cam, roller or other suitable component which can ride within the guide track 50 to control the rotational movement of the flap 40 relative to the hopper 30. Each of the guide devices 48 is received and travels along a respective guide track 50 disposed on each of the sidewalls 14 and 16. The guide tracks 50 may be rails attached to the housing 12 and located on the inside of each sidewall 14 and 16, or a slot formed in or on the inside of the sidewalls 14 and 16, for example. The guide tracks 50 are configured to cause the flap 40 to rotate relative to the hopper 30 as the hopper 30 is rotated between its fully closed position (shown in FIGS. 1 and 4) and its fully open position (shown in FIGS. 2 and 8).

Figure 5:
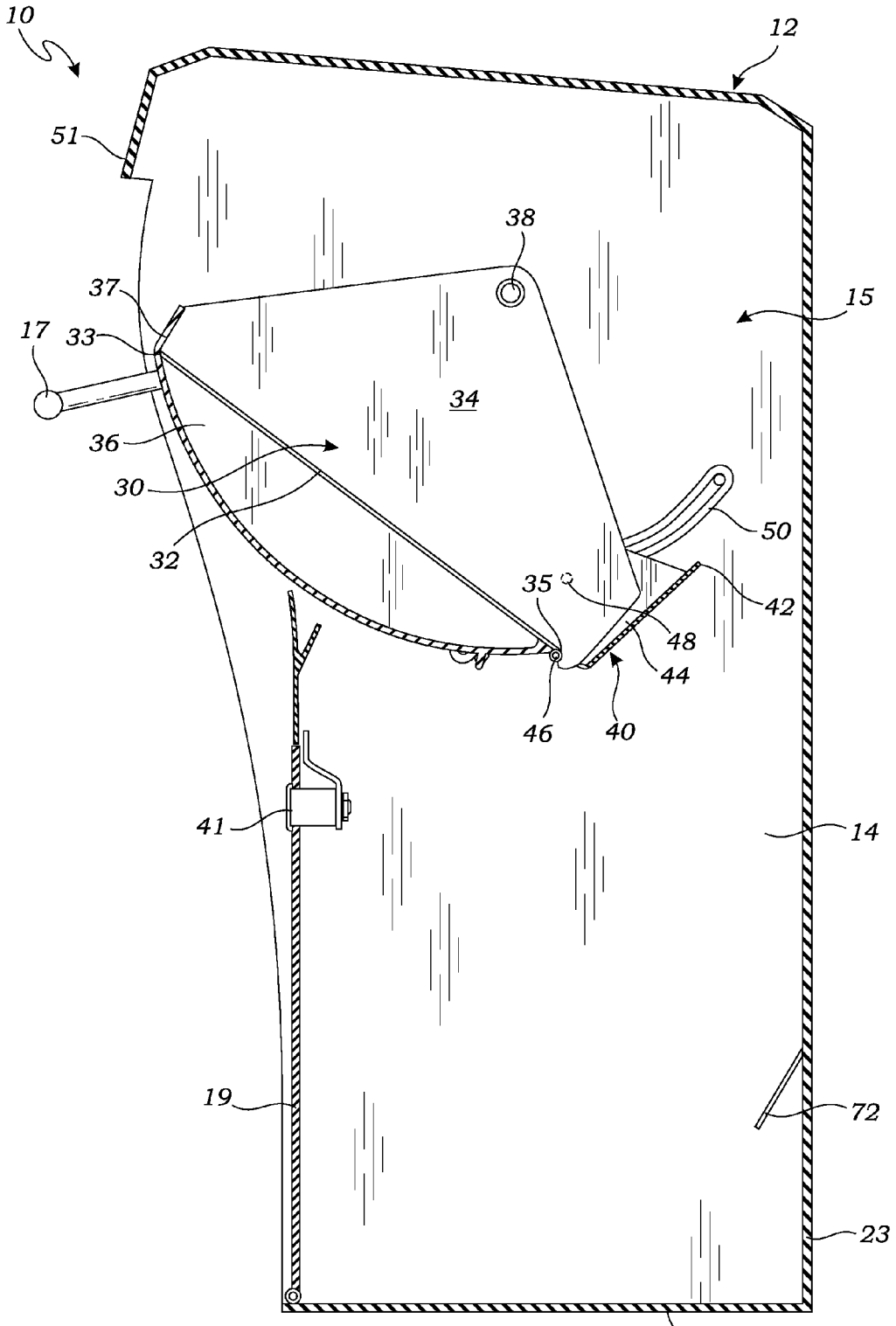
FIG. 5 is a side view of the receptacle of FIG. 1, with the hopper rotated partially from the fully closed position toward the fully open position.

The guide track 50 may be specifically configured to vary the rate of rotation of the flap 40 and to control the orientation of the slap 40 to a desired position for the particular position of the hopper 30. For instance, it may be desirable to have the flap 40 rotate quickly per amount of rotation of the hopper 30 when rotating from the fully closed position towards the open position. In this way, as the hopper cover 36 moves out of the way of the opening 22, it is desirable to have the flap 40 rotate upward from the down position to block direct access past the hopper 30 and into the drop area 39. The steeper the guide track 50, or more angled toward the axis of rotation of the hopper 30, the greater the rate of rotation of the flap 40 per amount of rotation of the hopper 30. For instance, if the guide track 50 simply travels at a constant radius equal to the distance of the guide device 48 from the axis of rotation of the hopper 30, the flap 40 will not rotate relative to the hopper 30 as the hopper 30 is rotated. Hence the guide track 50 is steep at the proximal end of the guide track 50 where the guide device 48 is located when the hopper 30 is moving from the fully closed position toward the open position. This causes the flap 40 to move quickly from the down position toward the up position such that the flap 40 extends above the bottom 32 and blocks part of the pathway between the bottom 32 and the drop area 39, as shown in FIG. 5. For instance, the guide track 50 path may be configured such that the hopper 30 rotation from FIG. 4 to FIG. 5 is approximately 25° to 35°, and more particularly approximately 28° (approximately 42% of the total rotation of the hopper 30), and during this rotation of the hopper 30, the guide track 50 causes the flap 40 to rotate between approximately 85° and approximately 95°, and more particularly approximately 93° (approximately 65% of the total rotation of the flap 40). Then, as the hopper 30 rotates further toward the open position, the radius of the guide track 50 increases thereby slowing the rate of rotation of the flap per amount of rotation of the hopper 30, as shown in FIG. 6. Then, as the hopper 30 approaches the fully open position, as shown in FIGS. 6-8, the radius of the guide track 50 decreases, thereby increasing the rate of rotation of the flap 40, but not quite as fast as the initial rate near the fully closed position. The upper and lower limits of the contour of the guide track 50 may be configured to substantially constrain the guide device 48, thereby providing little or no freedom for the flap 40 to rotate other than that dictated by the guide track 50. On the other hand, the upper and lower limits of the contour of the guide track 50 may be opened up to allow free rotation of the flap 40. For example, as described immediately below, the guide track 50 may be configured to allow manual rotation of the flap 40 at a desired position of the hopper 30, such as the fully closed position.

The guide track 50 may also be configured to allow the flap 40 to be manually rotated upward and out of the way of the access opening 43 to remove an object from the storage compartment 39. This may be accomplished by configuring the guide track 50 so that when the hopper 30 is in the fully closed position, the guide track 50 does not restrict upward movement of the guide device 48 so that the flap 40 may be rotated upward and out of the way of the access opening 43. For example, the guide track 50 can have a notch or widened area at the location of the guide device 48 when the hopper 30 is in the fully closed position.

Figure 16:
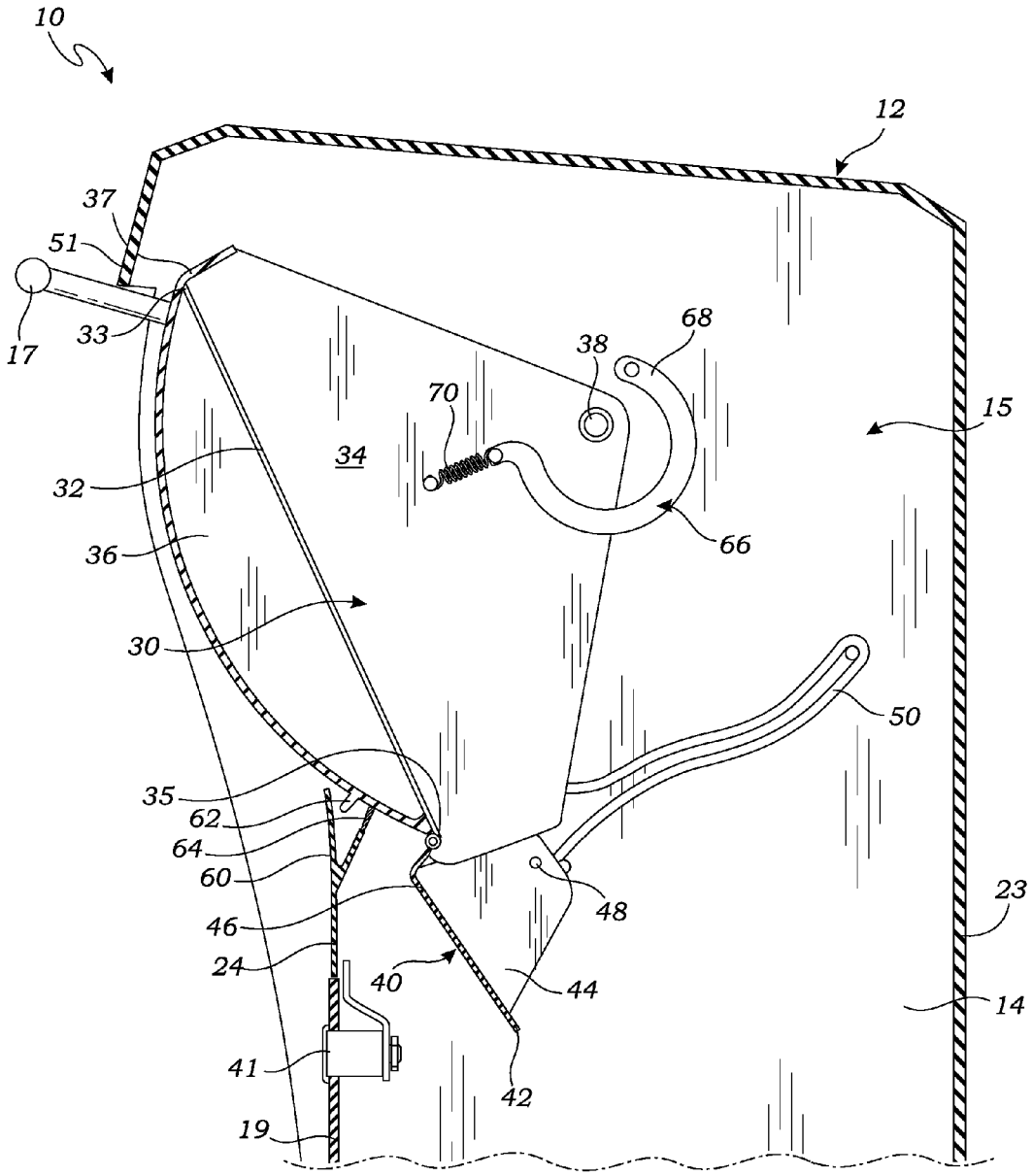
FIG. 16 is an enlarged, cutaway, side view of the upper portion of the receptacle of FIG. 1.

Turning now to the enlarged, partial view of FIG. 16, several additional features of the receptacle 10 will be described. The receptacle 10 may have a drainage system from reducing or preventing water from entering the housing 12. The drainage system includes a gutter 60, a deflector 62, and a brush 64 or other weather stripping. The gutter 60 is disposed on the inside of the front wall 24 and extends across at least substantially the entire width of the front wall 24, with an outlet at each end of the gutter 60 directed laterally to the outside of the housing 12. The deflector 62 is disposed on the outer surface of the hopper cover 36 and is positioned adjacent the gutter 60 when the hopper 30 is in the fully closed position. The brush 64 is attached to the top of one of the walls of the gutter 60 and extends toward the outer surface of the hopper cover 36. As rain or other water runs down the outer surface of the hopper cover 36, it will hit the deflector 62 and drip off the bottom edge of the deflector into the gutter 60. The gutter 60 leads the water to the lateral outlets at the either side of the front wall 24. The brush 64 seals the gap between the hopper cover 36 and the housing 12 to further prevent moisture from entering the housing 12 and also to hinder the possibility of seeing into the receptacle 10 through the gap between the hopper cover 36 and the gutter 60.

A spring mechanism 66 may also be provided to impart a force on the hopper 30 to bias the hopper 30 towards closing and/or otherwise assist in closing the hopper 30. The spring mechanism 66 comprises a hinged linkage 68 coupled to the housing 12 and a spring 70 coupled to the hopper 30, such as to the side panel 34. The spring mechanism 66 may be configured such that it begins to assist in closing the hopper 30 only when it is near the fully closed position, so it feels to the user as if it takes over the work of closing and keeping the hopper closed. Alternatively, the spring mechanism 66 may be configured to bias the hopper 30 toward the closed position throughout its rotation from the fully closed position to the fully open position. A single spring mechanism 66 may be utilized on just one side of the hopper 30, or a pair of spring mechanisms 66 can be utilized with one on each side of the hopper 30.

Another feature may include striations on the bottom 32 of the hopper 30, mail redirector 72, and/or inside of the bottom wall 18 of the housing 12 to reduce friction and facilitate movement of an object as it is slides off the bottom 32, falls against the mail redirector 72, and is removed from the drop area 39 through the access opening 43. The striations may be formed by grooves, ridges or the like on the surface of the components, oriented in the common direction of travel of an object being deposited and removed from the receptacle 10.

The operation of the receptacle 10, including the movement of the hopper 30 and the flap 40, will now be described with reference to FIGS. 4-14. In FIG. 4, the hopper 30 is in the fully closed position with the hopper cover 36 fully blocking the input opening 22 and the bottom 32 at an acute angle (greater than 45°) to horizontal, more particularly an angle of from 60° to 100°, or from 60° to 75°. The flap 40 is in the down position such that it is not obstructing an object from falling off the back edge 35 of the bottom 32, and more particularly, the flap 40 is at an angle ranging from −10° to 20°, or from 0° to 10°, to the bottom 32.

As shown in FIG. 5, the hopper 30 is opened by rotating the hopper 30 in a counter-clockwise direction. As the hopper 30 is opened, the housing cover 36 starts moving out of the way of the input opening 22 and the bottom 32 rotates toward a more horizontal position. As the hopper 30 rotates, the guide device 48 follows the guide track 50 causing the flap 40 to rotate relative to the hopper 30 from the down position to a partially up position such that the flap 40 extends above the bottom 32 thereby blocking part of the pathway between the bottom 32 and the drop area 39. This position of the flap 40 helps restrict unwanted access to the drop area, preventing theft of objects deposited into the receptacle.

The hopper 30 is further rotated toward the fully open position in FIG. 6, such that the housing cover 36 blocks even less of the input opening 22 and the bottom 32 is even more horizontal. The flap 40 is only slightly further rotated or not further rotated relative to the hopper 30 from the position in FIG. 5. It can be seen that the top of the flap 40 is very close to hitting the back wall 23 of the housing 12.

As shown in FIG. 7, the hopper 30 is further rotated almost to the fully open position. The hopper cover 36 is almost completely out of the way of the opening 22 and the bottom 32 is even closer to horizontal. The flap 40 has further rotated relative to the hopper 30, which was necessary to avoid having the top wall of the flap 40 hit the back wall 23 of the housing 12. Between the position of FIG. 6 and the position of FIG. 7, the top of the flap 40 moves along a path very close to the back wall 24 leaving very little gap to access past the hopper 30 and into the drop area 39.

With further counter-clockwise rotation, the hopper 30 reaches the fully open position, as shown in FIG. 8. The hopper cover 36 is substantially clear of the input opening 22, providing free access through the input opening 22 to place an object on the bottom 32. The bottom 32 has now rotated just slightly past horizontal, such that the bottom 32 is about horizontal, and more particularly, the bottom 32 is within 10° of horizontal. The flap 40 has rotated to the up position such that the flap 40 forms a back wall adjacent the rear edge 35 of the bottom 32 and extending upward above the rear edge 35. The flap 40 is substantially flush against the back wall 24 of the housing 12.

Figure 9:
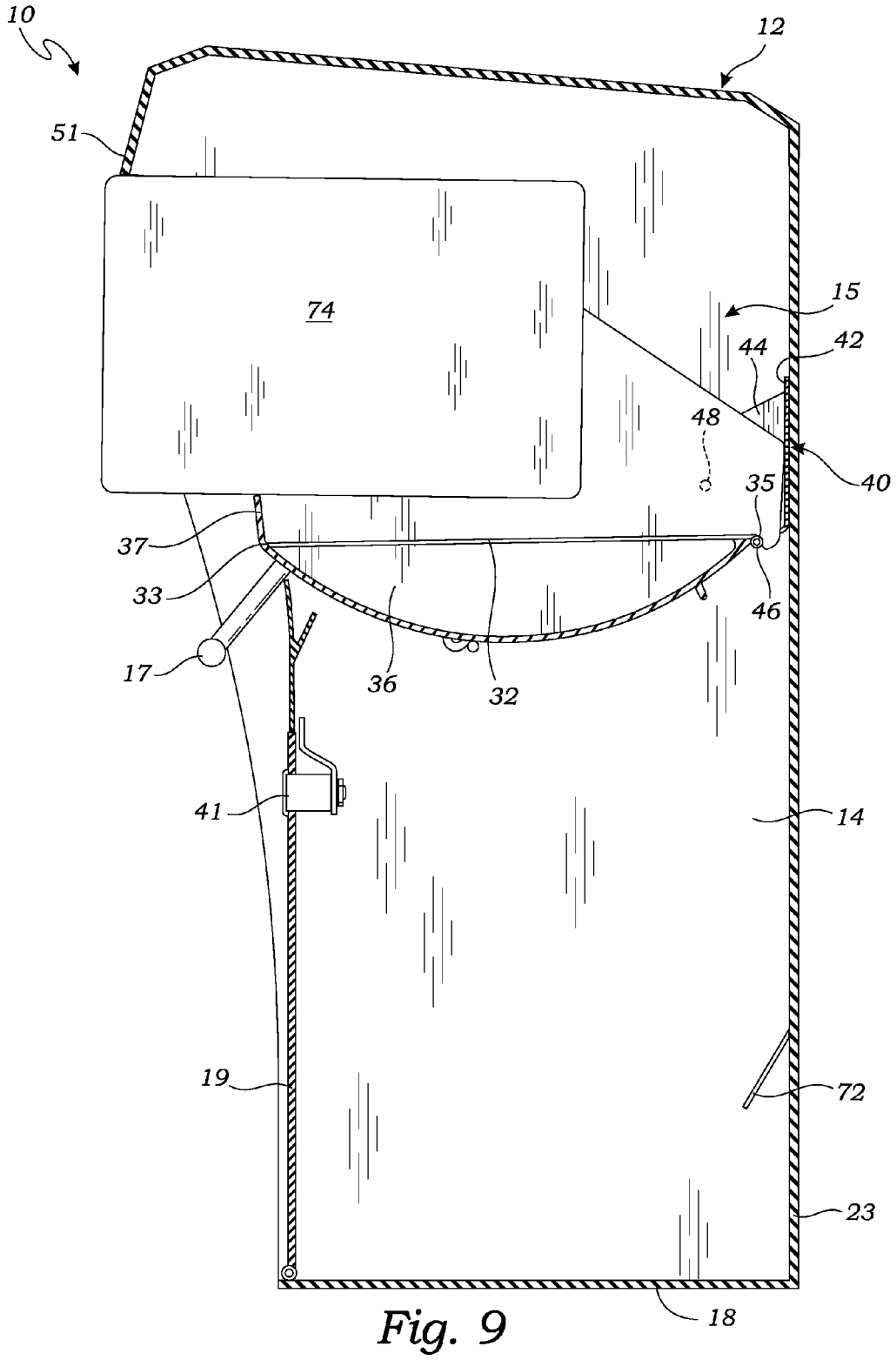
FIG. 9 is a side view of the receptacle of FIG. 1, with a package being inserted through the input opening onto the bottom of the hopper with the hopper in the fully open position.
Figure 10:
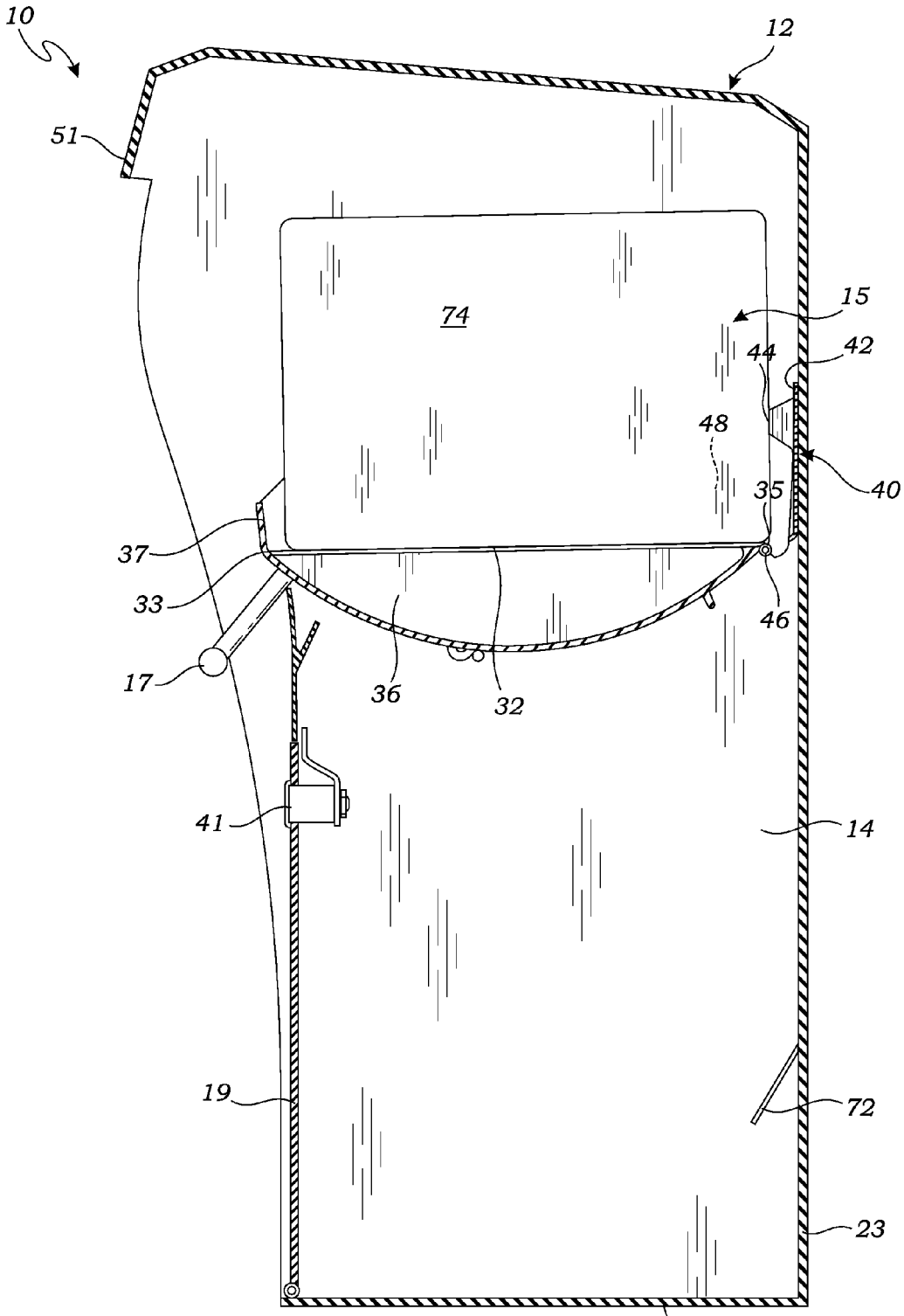
FIG. 10 is a side view of the receptacle of FIG. 1, with a package fully inserted onto the bottom of the hopper with the hopper in the fully open position.

As shown in FIG. 9, with the hopper 30 in the fully open position, a parcel (object) 74 may be placed through the input opening 22 and onto the bottom 32. As shown in FIG. 10, the parcel 74 is inserted all the way past the front lip 37 of the hopper 30 and onto the bottom 32.

Figure 11:
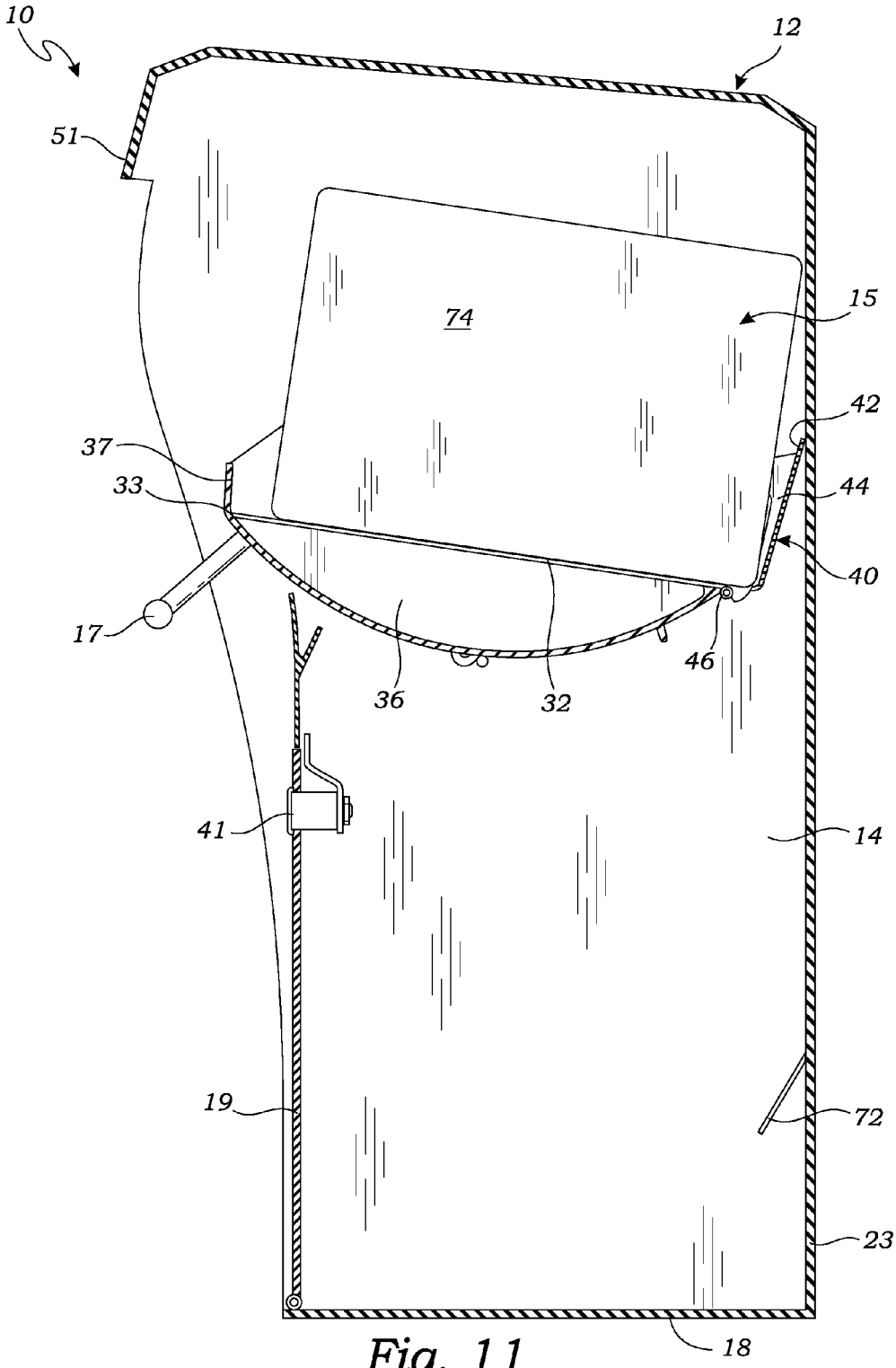
FIG. 11 is a side view of the receptacle of FIG. 1, with a package positioned on the bottom of the hopper and the hopper rotated partially from the fully open position toward the fully closed position.

As shown in FIG. 11, the hopper 30 is now rotated in the opposite direction (clockwise direction), toward the closed position. As the hopper is rotated toward the closed position, the hopper cover 32 begins to partially block the input opening 22, the bottom 32 rotates to a downward angle, and the flap 40 rotates from the up position toward the down position. The flap 40 is still above the rear edge 35 so that it forms a back wall preventing the parcel 74 from sliding off the bottom 32.

Figure 12:
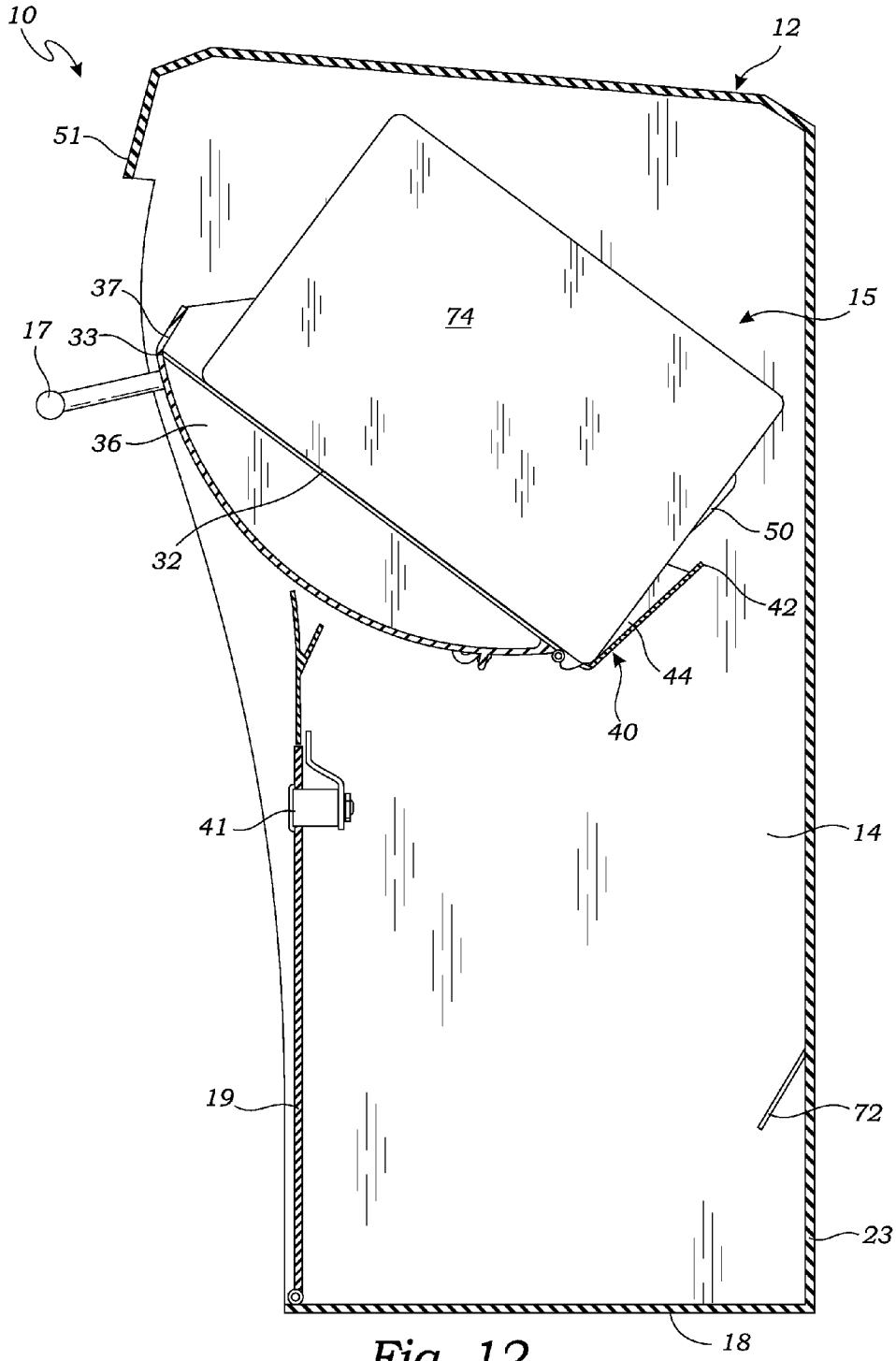
FIG. 12 is a side view of the receptacle of FIG. 1, with a package positioned on the bottom of the hopper and the hopper rotated even further toward the fully closed position.

As shown in FIG. 12, the hopper 30 is further rotated toward the closed position. The hopper cover 36 covers more of the input opening, the bottom 32 tilts further downward, and the flap may rotate further toward the down position. In this position, flap 40 is still above the rear edge 35 so that it forms a back wall preventing the parcel 74 from sliding off the bottom 32.

Figure 13:
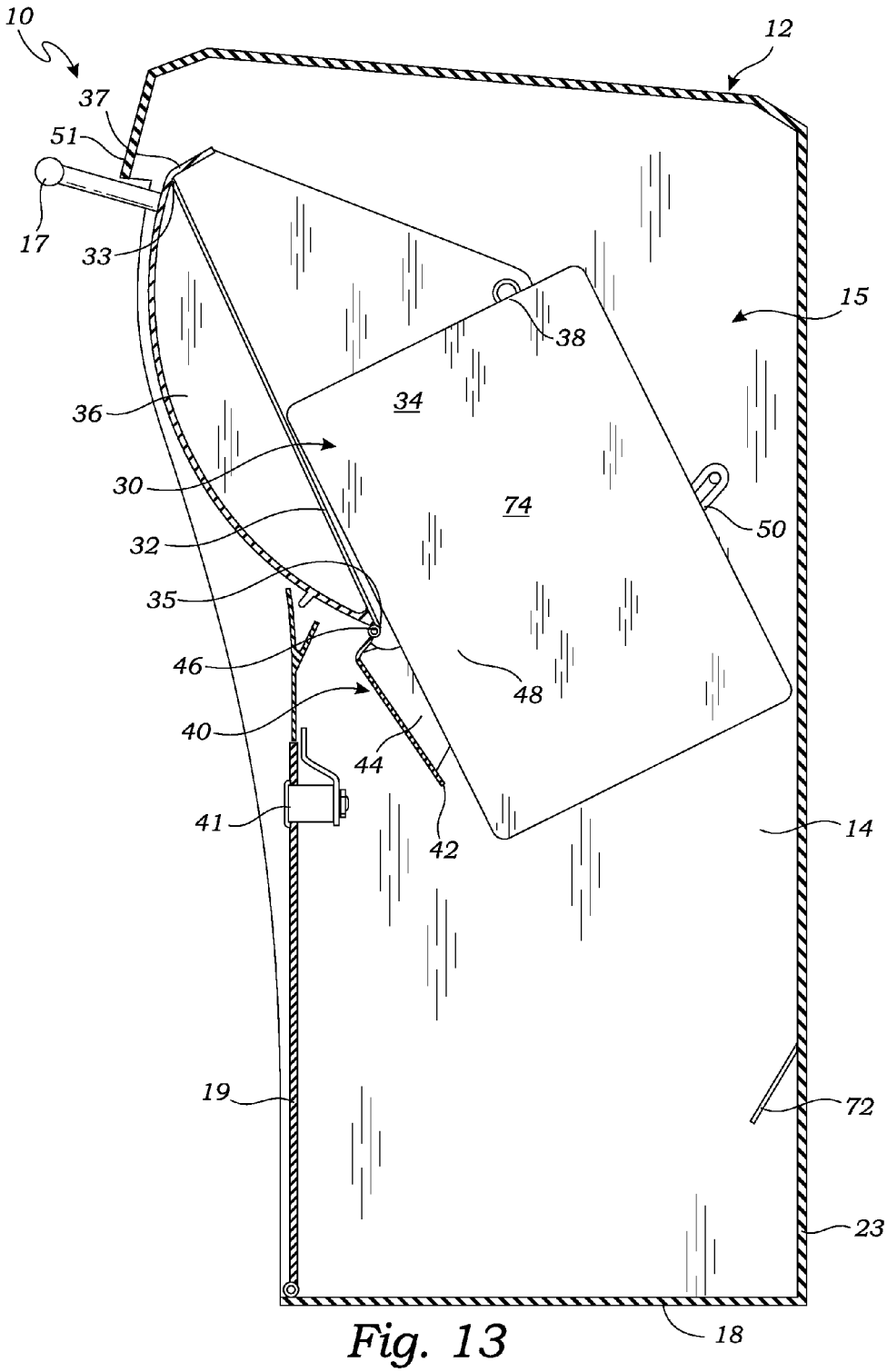
FIG. 13 is a side view of the receptacle of FIG. 1, with the hopper rotated to the fully closed position and showing a package sliding off the bottom of the hopper toward the drop area.

As shown in FIG. 13, the hopper is now rotated to the fully closed position. The bottom 32 is at the steep angle described above for the fully open position. The flap 40 has now moved to the down position allowing the parcel 74 to slide over the flap 40 and off the bottom 32.

Figure 14:
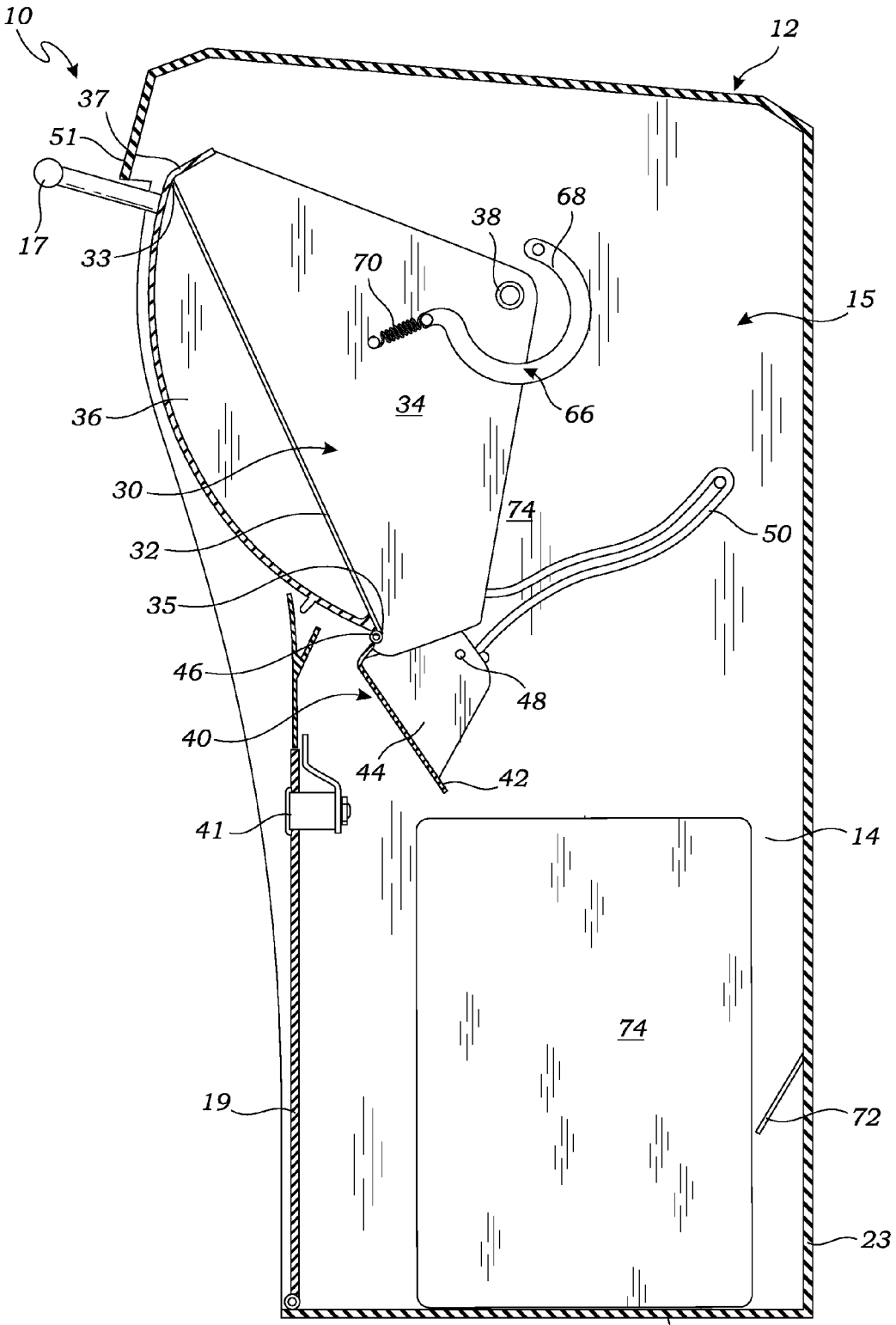
FIG. 14 is a side view of the receptacle of FIG. 1, with the hopper rotated to the fully closed position and showing a package that has slid completely off the bottom of the hopper and into the drop area.

As shown in FIG. 14, the parcel 74 has slid completely off the bottom 32, has deflected off the redirector 72, and has fallen into the drop area 39.

As described above with respect to FIG. 15, the parcel 74 may be removed from the receptacle by unlocking and unlatching the locking latch 41 and opening the access door 19. If necessary, the flap 40 may be manually rotated upward and out of the way of the access opening. The parcel 74 can then be removed through the access opening 43. The access door 19 may then be closed, latched and locked, and the receptacle is ready to receive another object.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A receptacle for receiving and securing an object, comprising:

a housing including a housing cover having an input opening;

a hopper rotatably coupled to the housing, the hopper disposed within the housing cover, the hopper having a bottom for supporting an object placed into the hopper, the bottom having a front edge and a rear edge, the front edge being adjacent the input opening in the housing cover and the rear edge being distal to the front edge, the hopper rotatable between a fully open position in which the bottom is accessible through the input opening to place an object through the input opening onto the bottom, and a fully closed position in which the input opening is at least substantially blocked by the hopper;

a flap rotatably coupled to the hopper to rotate relative thereto, the flap rotatable between an up position when the hopper is in the fully open position in which the flap forms a back wall adjacent the rear edge of the bottom and extending upward above the rear edge, and a down position when the hopper is in the fully closed position in which the flap allows an object to slide off the bottom and out of the hopper.

2. The receptacle of claim 1, further comprising:

a guide track coupled to the inside of the housing; and a guide device coupled to the flap, the guide device configured to travel along the guide track during movement of the hopper between the fully open position and the fully closed position such that the guide device causes the flap to rotate relative to hopper between the up position and down position of the flap.

3. The receptacle of claim 2, wherein the hopper further comprises a hopper cover disposed under the bottom, and in the fully closed position, the hopper cover substantially blocks the input opening.

4. The receptacle of claim 2, wherein the guide track is one of a slot formed in a component of the housing, or a rail coupled to the housing.

5. The receptacle of claim 4, wherein the guide device is one of a pin, a cam, or a roller.

6. The receptacle of claim 5, wherein the guide track is configured to allow the flap to be moved manually into the up position when the hopper is in the fully closed position.

7. The receptacle of claim 6, wherein the guide track is configured to rotate the flap at a greater rate of rotation per amount of rotation of the hopper near the fully closed position than near the fully open position.

8. The receptacle of claim 7, further comprising a mail redirector disposed within a back portion of the housing configured to direct an object dropping from the hopper toward a front of the housing.

9. The receptacle of claim 8, further comprising a gutter positioned to channel water towards an outside of the housing, and a deflector positioned to direct water running off the hopper cover into the gutter.

10. The receptacle of claim 9, further comprising a weather-stripping positioned to visually seal a gap between the hopper and the gutter.

11. The receptacle of claim 10, wherein the receptacle is configured such that in the fully open position, the bottom of the hopper is about horizontal and the flap is at about an angle of 90° to the bottom.

12. The receptacle of claim 11, wherein the receptacle is configured such that in the fully closed position, the bottom of the hopper is at an angle from 60° to 100° relative to horizontal and the flap is at an angle from −10° to 20° relative to the bottom.

13. The receptacle of claim 12, wherein the receptacle is configured to receive a rectangular box having a length of about 11.25 inches, a width of about 5.75 inches and a height of about 8.75 inches, and not more than 1 inch larger in any one or more of the dimensions.

14. The receptacle of claim 13, wherein the receptacle is configured as a mail receptacle.

15. The receptacle of claim 14, wherein the housing comprises a storage compartment having a second opening and a door, the door covering the second opening configured to be opened to access to an interior of the storage compartment in an open position.

16. The receptacle of claim 15, wherein the housing is configured to be mounted to a structure.

17. A receptacle for receiving and securing an object, comprising:

a housing including a housing cover having an input opening;

a hopper rotatably coupled to the housing, the hopper disposed within the housing cover, the hopper having a bottom for supporting an object placed into the hopper, the bottom having a front edge and a rear edge, the front edge being adjacent the input opening in the housing cover and the rear edge being distal to the front edge, the hopper having a hopper cover disposed under the bottom, the hopper rotatable between a fully open position in which the bottom is accessible through the input opening to place an object through the input opening onto the bottom, and a fully closed position in which the input opening is at least substantially blocked by the hopper cover;

a flap rotatably coupled to the hopper to rotate relative thereto, the flap rotatable between an up position when the hopper is in the fully open position in which the flap forms a back wall adjacent the rear edge of the bottom and extending upward above the rear edge, and a down position when the hopper is in the fully closed position in which the flap allows an object to slide off the bottom and out of the hopper.

18. The receptacle of claim 17, wherein the receptacle is configured such that in the fully open position, the bottom of the hopper is about horizontal and the flap is at about an angle of 90° to the bottom.

19. The receptacle of claim 18, wherein the receptacle is configured such that in the fully closed position, the bottom of the hopper is at an angle from 60° to 100° relative to horizontal and the flap is at an angle from −10° to 20° relative to the bottom.

20. The receptacle of claim 19, further comprising:

a guide track coupled to the inside of the housing; and a guide device coupled to the flap, the guide device configured to travel along the guide track during movement of the hopper between the fully open position and the fully closed position such that the guide device causes the flap to rotate relative to hopper between the up position and down position of the flap.

* * * * *